US005301800A

United States Patent [19]

Kenney

[11] Patent Number: 5,301,800

[45] Date of Patent: Apr. 12, 1994

[54] LITERATURE DISPLAY HOLDER AND BLANK FOLDABLE TO FORM SAME

[76] Inventor: Richard E. H. Kenney, 566 Brooker Ridge, Newmarket, Ontario, Canada, L3X 1V7

[21] Appl. No.: 26,769

[22] Filed: Mar. 5, 1993

[51] Int. Cl.[5] ..... B65D 5/52

[52] U.S. Cl. ..... 206/45.26; 206/45.17; 206/45.18; 206/45.25; 248/174; 211/50; 211/73

[58] Field of Search ..... 206/44.11, 45.18, 45.17, 206/45.24, 45.25, 45.26; 211/50, 72, 73, 132; 248/174

[56] References Cited

U.S. PATENT DOCUMENTS

| | | | |
|---|---|---|---|
| Re. 32,668 | 5/1988 | Smith | 248/174 |
| 2,197,806 | 4/1940 | MacDonald | 211/72 |
| 2,723,820 | 11/1955 | Schulz et al. | 211/73 |
| 3,128,984 | 4/1964 | Palm | 248/174 |
| 3,185,294 | 5/1965 | Lustman | 206/45.25 |
| 4,819,792 | 4/1989 | Christian | 206/45.25 |
| 4,938,365 | 7/1990 | Conway et al. | 211/50 |
| 4,962,859 | 10/1990 | Kump | 211/50 |
| 5,029,798 | 7/1991 | Clark | 248/459 |
| 5,165,649 | 11/1992 | Neumann et al. | 206/45.26 |

FOREIGN PATENT DOCUMENTS

| | | | |
|---|---|---|---|
| 470689 | 1/1929 | Fed. Rep. of Germany | 211/73 |

*Primary Examiner*—David T. Fidei
*Attorney, Agent, or Firm*—Ridout & Maybee

[57] ABSTRACT

A literature holder formed form a flat blank by folding forwardly side panels attached on each side of a back panel. A foot portion is connected on the bottom end of each side panel and is formed by a cut in the blank extending inwardly from the folding line, which terminates at the upper side of the cut, downwardly toward a lower end of the back panel, so that when the side panel is swung forwardly, the foot portion swings rearwardly about the axis of the folding line. At each side, the lower edge of the side panel and its foot portion inclines upwardly inwardly so that, in the erected state, the back panel inclines rearwardly upwardly when the forwardly projecting side panel and rearwardly projecting foot portion are placed on a flat surface. A front panel and a bottom panel bridge the front and bottom edges of the side panels, respectively, forming a compact, stable and efficient holder.

19 Claims, 3 Drawing Sheets

LITERATURE DISPLAY HOLDER AND BLANK FOLDABLE TO FORM SAME

BACKGROUND OF THE INVENTION

The invention relates to a holder for literature and more especially to a holder that can be provided in the form of a flat blank easily erectable to provide the holder in finished form.

Literature holders for pamphlets, brochures, flyers, application forms, maps, and like literature are commonly displayed in stores, banks, tourist information centers, restaurants, offices and the like. It is in many cases desirable that the literature holder should be provided in the form of a flat blank that can be relatively easily erected to form the literature holder. As compared with rigid moulded plastic literature holders, for example, the flat blank is less bulky and usually more light weight. The distributor of the literature can pack a stock of the literature together with the flat blank compactly for forwarding, for example by mailing, to the locations where the literature is to be displayed. Additionally, it is relatively easy to customize the flat blanks by printing them with material desired to be associated with the distribution of the literature, for example informational, advertising or trademark material.

Flat blanks erectable to form literature holders are shown in U.S. Pat. Nos. 4,819,792 to Christian and 4,962,859 to Kump. Christian employs a blank having widely outwardly projecting lateral tabs and is therefore not as compact and is not as efficient as may be desired in its utilization of the sheet material from which the blank is cut. In addition, the erected holder may not provide as much stability and lateral support for the stock of literature as may be desired.

Kump shows a literature holder with a deep rectangular base and formed from a blank having widely extending side flaps and a deeply extending bottom panel and the blank again is not as efficient in its utilization of the sheet material as may be desired. Further, the front and rear walls of the literature holder incline upwardly inwardly so that the stock of literature tends to be supported by line contact on the rear wall and is prone to shifting and tilting within the holder, so that the stability of the stock of literature may not be adequate for all purposes.

SUMMARY OF THE INVENTION

The present invention provides a flat folding holder for literature comprising a back panel having an upper and a lower end and having side edges. A side panel is connected to each side edge of the back panel and is folded generally forwardly with respect thereto. Each side panel has an integral rearwardly projecting foot portion comprising an area that is cut from the back panel and is swung outwardly rearwardly from the plane of the back panel adjacent its lower edge. Each side panel and its foot portion have a lower edge inclining upwardly rearwardly from a front edge of the side panel toward a rear edge of the foot portion so that the back panel inclines upwardly rearwardly when the holder is placed on a plane surface. The holder includes a front panel that bridges the front edges of the lower portion of each side panel.

The invention also provides a blank that is foldable to form the above holder.

With this arrangement, the rearwardly extending foot portions stabilize the erected holder and prevent rearward tipping of the holder. Since the foot portions are provided by areas cut from and deflected outwardly rearwardly with respect to the back panel, relatively long stabilizing foot portions can be provided without needing to increase the overall width of the blank and hence increasing the efficiency of utilization of the sheet material from which the blank is cut. Since the back panel of the holder can be made relatively long and inclines rearwardly, the depth of the holder between the front and back panels can be quite small and this increases the efficiency of utilization of the sheet material. In addition, the stock of literature rests stably in the holder in a rearwardly inclined attitude and is not prone to sudden shifting or tipping.

Examples of flat blanks and literature holders folded therefrom in accordance with the invention will now be described in more detail with reference to the accompanying drawings.

DESCRIPTION OF THE PREFERRED EMBODIMENT

Figure 1:
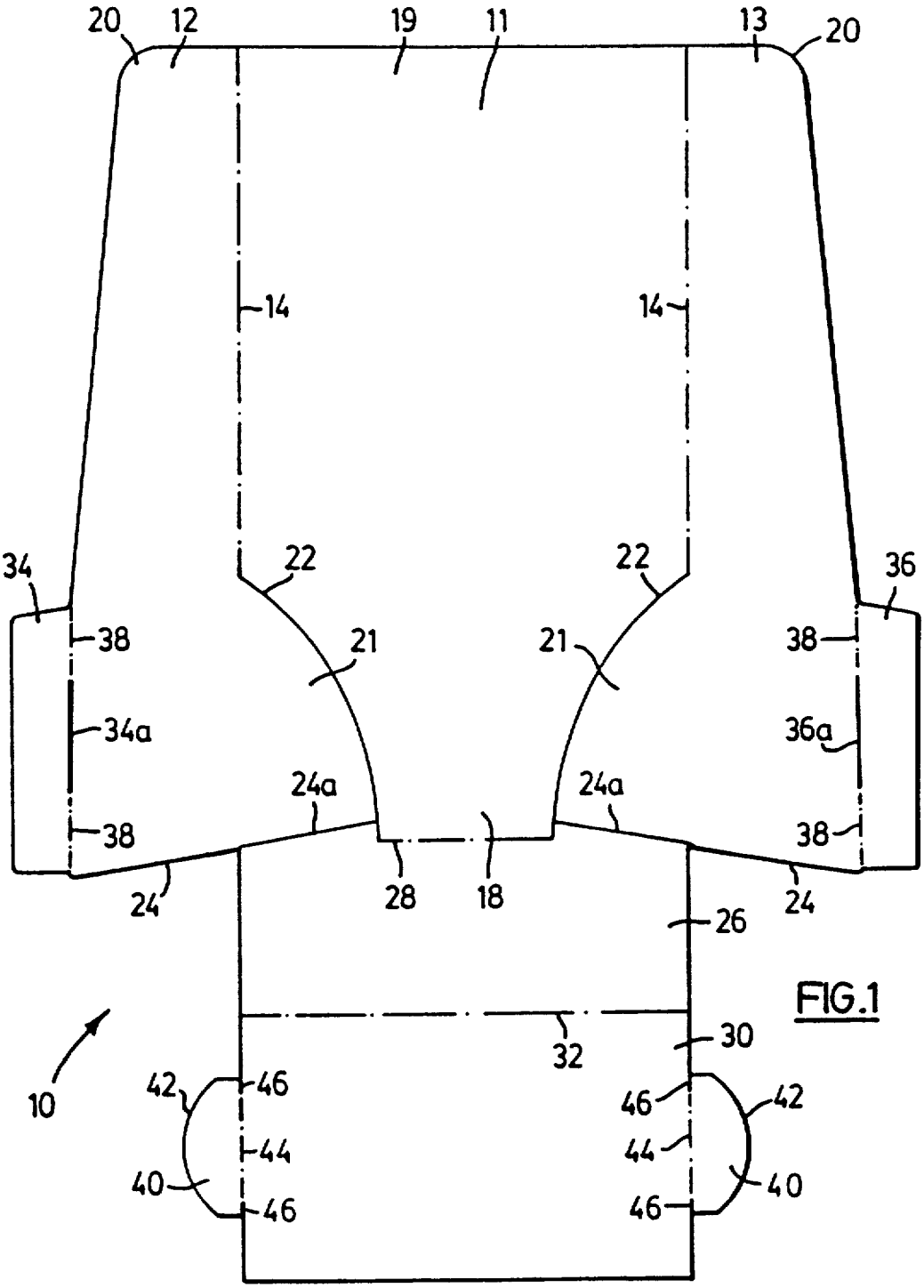
FIG. 1 shows a plan view of a blank cut from sheet material for use in forming the preferred form of literature holder in accordance with the invention.

The blank 10 shown in FIG. 1 is formed by cutting or stamping from sheet material, preferably a stiffly flexible sheet material. For example, the sheet material may be a sheet plastic material, such as sheet polyethylene.

The blank 10 comprises a generally rectangular back panel 11. On each side is integrally joined a side panel, 12 and 13 respectively. Between the panel 11 and each side panel is a line of weakening 14, facilitating folding of the side panels 12 and 13 out of the plane of the back panel 11. All such lines of weakening in the accompanying drawings are shown by chain-dotted lines. The weakening lines may be, for example, a line of perforations formed through the panel or may be any other conventional form of weakening line. Preferably the weakening lines are continuous lines of thinning of the sheet material, for example scoring lines or, more preferably, narrow lines of continuous indentation.

Figure 3:
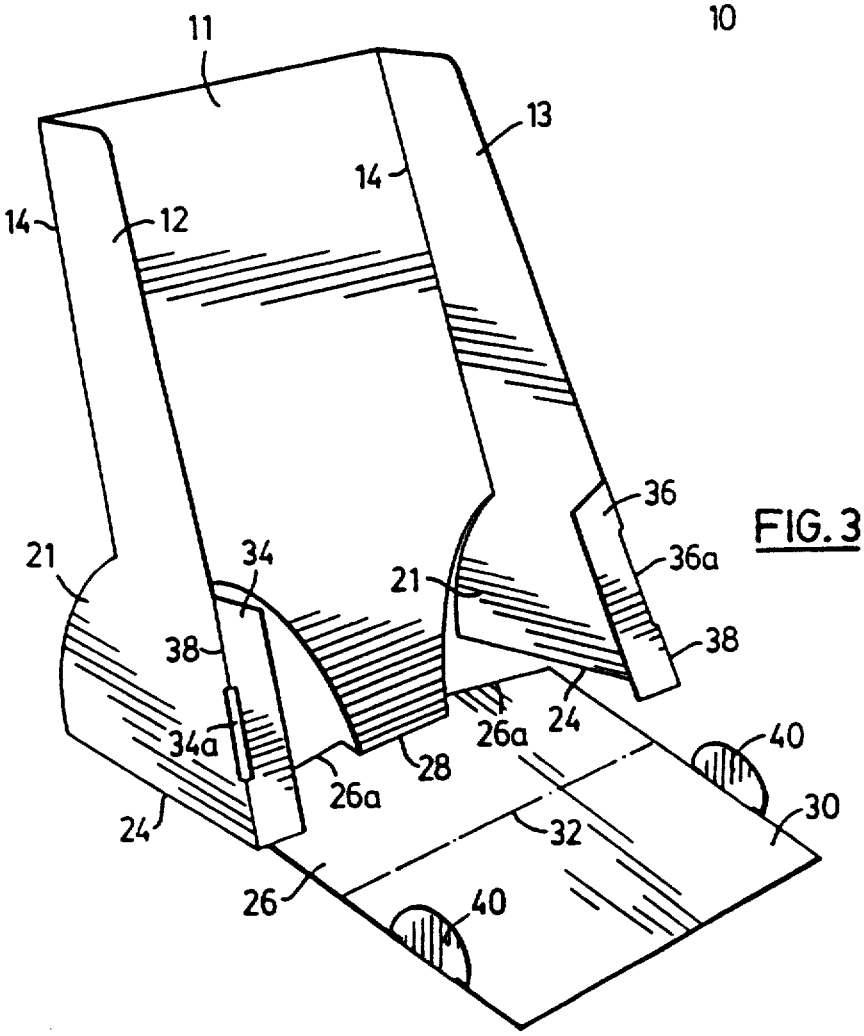
FIG. 3 is a perspective view illustrating how the blank of FIG. 1 together with a stock of literature may be inserted in a mailing envelope.
Figure 4:
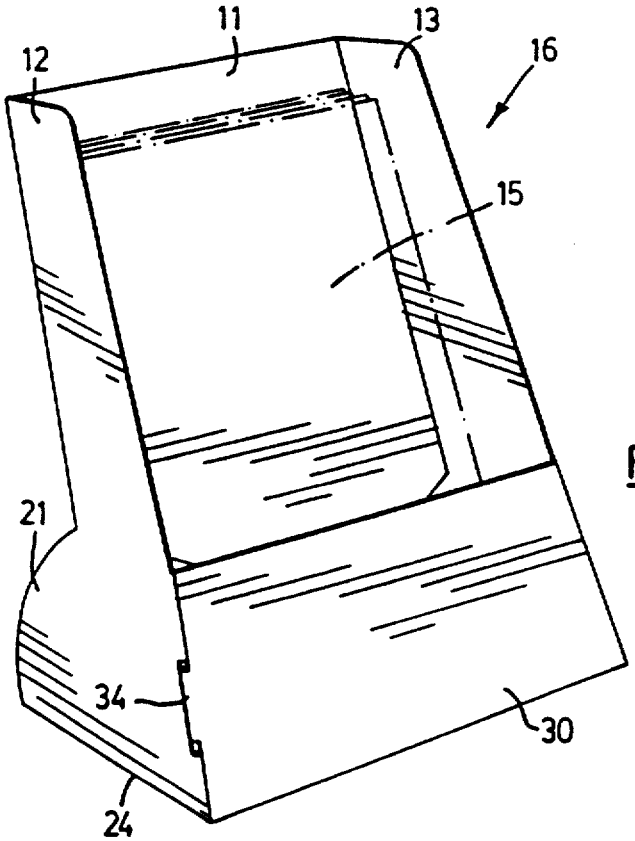
FIG. 4 shows the final erected holder formed from the blank of FIG. 1.

The lines 14 may be slightly inclined with respect to one another but preferably are substantially parallel so that, when the side panels 12 and 13 are folded forwardly, as seen in FIGS. 3 and 4, they define with the back panel 11 a channel of substantially constant width. This allows a stack of literature of usually rectangular shape, as indicated by phantom lines at 15 in FIG. 4, to be stably supported within the finished holder which is indicated at 16 in FIG. 4, and the literature can be easily placed in and withdrawn from the holder 16. Each side panel 12 and 13 tapers in width from a first or lower end portion 18 of the panel 11 toward a second or upper end 19. Preferably, the upper outer corner 20 of each panel 12 and 14 is convexly rounded.

Each of the side panels is formed integrally with a generally inwardly extending foot portion 21 adjacent the lower or first portion 18. As seen in FIG. 1, each foot portion 21 projects laterally inwardly with respect to the adjacent weakening line 14, which terminates at an arcuate cut 22 defining the upper edge of the foot portion. Each cut 22 preferably extends from the weakening line convexly, with respect to the foot portion 21, toward a central portion of said lower portion 18.

The lower edge 24 of each foot portion 20 and of the adjacent side panel 12 or 13 together comprise a straight line inclining laterally inwardly, at an angle with respect to the weakening line 14, from the outer edge of the side panel 12 or 13 generally in the direction from the lower or first end portion 18 of the panel 11 toward the upper or second end 19.

When the side panels 12 and 13 are folded about the weakening lines 14 to extend forwardly in the same direction from the back panel 11, preferably substantially parallel to one another and at right angles to the panel 11, the integrally attached foot portions 21 swing outwardly correspondingly rearwardly, as seen in FIG. 3, about the weakening line 14 as a pivot axis, to extend in the direction opposite to the side panels 12 and 13. Because of the inclination of the bottom edges 24 of the side panels 12 and 13 and foot portions 21 relative to the weakening lines 14, when the holder is placed on a planar surface, the back panel 11 inclines rearwardly at the same angle, as seen in FIGS. 3 and 4.

In the blank, the inner portion of the edge 24 is defined by a cut 24a which in the embodiment of FIGS. 1 to 4 separates the foot portions 20 from a bottom panel 26 of substantially the width of the back panel 11, and integrally connected to the lower central portion 18 through a weakening line 28. The line 28 is at right angles to the lines 14 in the case in which these are parallel to one another. In the event the lines 14 are somewhat inclined with respect to one another, the line 28 should extend at right angles to the bisector between the lines 14, so that, when folded forwardly, as seen in FIG. 3 the panel 26 extends laterally substantially horizontally to support the lower edge of a stock of literature 15. Preferably, the weakening line 28 is offset slightly from the rear edges of the bottom panel 26, defined by the cuts 24a, so that, when the bottom panel 26 is bent forwardly, as seen in FIG. 3 the rear edges 26a of the panel 26 extend somewhat rearwardly of the line 28. Desirably, the line 28 is aligned with the imaginary points of intersection between the weakening lines 14 and the lower edges 24 of the side panels 12 and 13. In the course of erecting the holder, as seen in FIG. 3, the bottom panel 26 then tends to pass under the lower edges 24 when the side panels 12 and 13 and the bottom panel 26 are folded forwardly, and tends to occupy a plane parallel with and preferably slightly below the plane of the lower edges 24.

A front panel 30 is integrally connected to the bottom panel 26 through a weakening line 32 and is substantially the same width as the panel 26. In addition, small side flaps 34 and 36, respectively, of length approximately equal to the length of the front panel 30 are provided on the outer edges of the side panels 12 and 13, and are connected to the side flaps through weakening lines 38. Slots 34a and 36a are formed in the material of the blank coincident with the weakening lines 38.

A tab 40 is provided integrally on each end of the front panel 30. Each tab 40 has a convexly rounded leading edge 42 to assist in insertion of the tabs 40 into the slots 34a and 36a. Each tab 40 is connected to the panel 30 through a weakening line 44 and adjacent each end has a cut 46 defining a narrow neck portion coincident with the weakening line 44.

The width of each of the slots 34a and 36 is approximately the thickness of the sheet material from which the blank is formed and its length is somewhat less than the full width of the tab 40 but somewhat greater than the width of narrow neck portion so that by inclining the tab 40 relative to the material of the blank containing the slots 34a and 36a, the tabs 40 can be inserted through the slots and engaged lockingly thereon.

The slots 34a and 36a and tabs 40 are positioned so that, when the side flaps 34 and 36 are folded inwardly, as seen in FIG. 3, and the front panel 30 folded upwardly as seen in FIG. 4, insertion of the tabs into the slots 34a and 36a locates the weakening line 32, and the front edge of the bottom panel 26, approximately at the lower edge of the side flaps 34 and 36 and side panels 12 and 13. With this arrangement, the bottom panel 26 extends horizontally parallel to the lower edges 24 and therefore provides a stable horizontal base for supporting a stock of literature within the holder. The length of the bottom panel 26, between the weakening lines 28 and 32, is such that in the erected state the lower central portion 18 remains in the same plane as the upper portion of the back panel 11.

Figure 2:
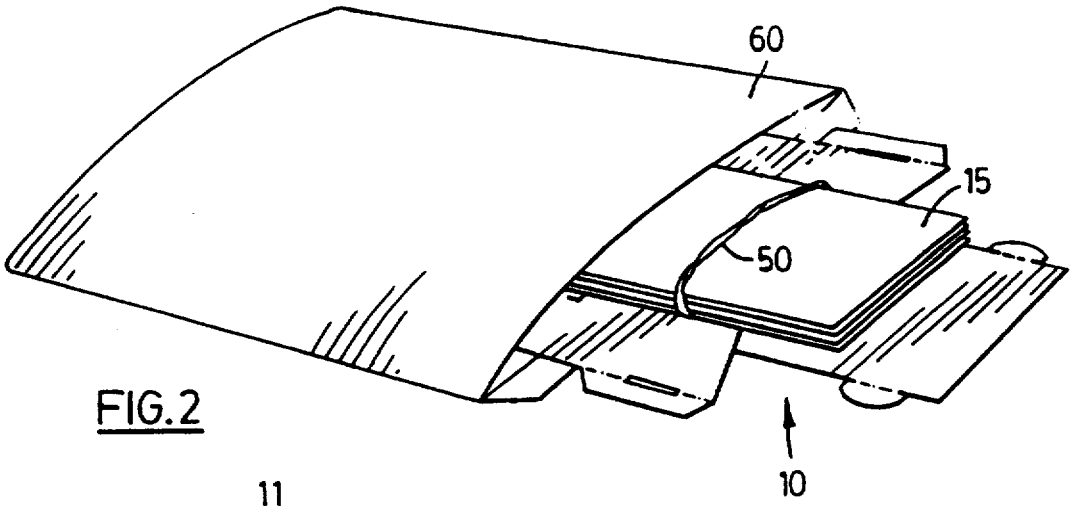
FIG. 2 is a perspective view showing an intermediate stage in the folding up of the blank of FIG. 1 to form the literature holder.

In use, typically the blank 10 is packed together with a stock of literature 15, shown held together by an elastic band 50 and is placed in an envelope 60, as seen in FIG. 2 for mailing to a location where the literature is to be displayed. As noted above, the compactness and lightweight of the blank 10 make it especially advantageous for mailing or for other forms of shipping.

The end user can readily assemble the holder 16 by creasing the sheet material of the blank inwardly at all weakening lines 14, 28, 32, 38 and 44, thereby folding the side panels 12 and 13 forwardly and swinging the foot portions 21 rearwardly, as seen in FIG. 3 while erecting the flaps 34 and 36 relative to the side panels 12 and 13 and the tabs 40 relative to the panel 30. On folding the panel 30 upwardly relative to the bottom panel 26, firstly the lower edge of each tab 40 can be inserted through the slots 34a and 36a while the panel 30 is held inclined upwardly slightly outwardly and then the upper edge of each tab 40 can be snapped to lock behind the material defining the slots, to form the completed holder shown in FIG. 4. It will be noted both the front and rear panels 30 and 11 incline rearwardly so that a stable holder for the stock of literature 15 is provided.

Various modifications of the holder and blank described in detail above with reference to FIGS. 1 to 4 are of course possible. For example, instead of forming the flaps 34 and 36 provided with the slots 34a and 36a on the side panels 12 and 13, respectively, they may be formed on the side edges of the front panel 30, and the tabs 40 may be formed on the side edges of the panels 12 and 13.

Figure 5:
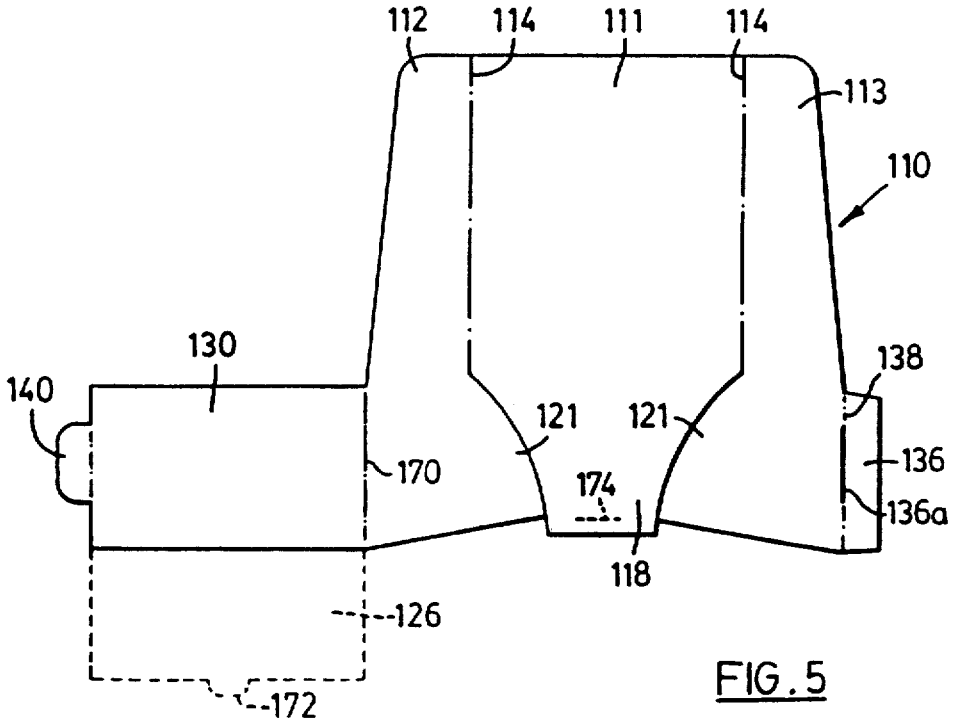
FIG. 5 shows a further example of a blank for forming another form of literature holder in accordance with the invention.

FIG. 5 shows a further embodiment in which elements similar to those of the embodiment of FIG. 4 are denoted by the same reference numerals raised by 100. In FIG. 5, the front panel 130 is connected directly on one side panel 112 through a weakening line 170. When the holder is erected, side flap 136 is folded inwardly and tab 140 locked in slot 136a to connect the front panel to bridge across the side flaps 112 and 113, similar to the erected holder 16 of FIG. 4. This version is considerably less advantageous because the panel 130 projecting laterally makes the blank 110 less compact and less efficient in its utilization of sheet material. These problems may be reduced by pre-folding the panel 130 about the weakening line 170 for mailing and by staggering and/or inversion of adjacent blanks struck from the sheet. Desirably, a closed bottom is provided for the holder so that literature will not fall out if the holder is lifted, and a bottom panel 126 may be included, connected to one edge of the front panel 130 through a weakening line and having a tab 172 insertable into a slot 174 in the lower portion 118 of the back panel 111.

I claim:

1. A holder for literature comprising:

a) a back panel having upper and lower portions and having side edges;

b) a side panel connected to each side edge of said back panel, each side panel folded generally forwardly with respect to said back panel;

c) each side panel having an integral rearwardly projecting foot portion, each foot portion having an area cut from said lower portion of said back panel and swung outwardly rearwardly from the plane of said back panel;

d) each side panel having a lower edge inclining with respect to the adjacent side edge of said back panel upwardly rearwardly from a front edge portion of said side panel toward a rear edge of said foot portion so that said back panel inclines upwardly rearwardly when the holder is placed on a plane surface;

e) a front panel; and f) means for connecting said front panel to bridge said front edge portions adjacent a lower portion of each side panel.

2. A holder as claimed in claim 1, and further comprising:

a) a weakening line extending from an upper edge of said back panel adjacent each side panel and terminating at said area, so that inward and forward folding of each side panel swings said foot portion connected thereto outwardly rearwardly.

3. A holder as claimed in claim 1, and further comprising:

a) a bottom panel having a width substantially the same as said back panel connecting between a lower edge of said front panel and said lower portion of said back panel.

4. A holder as claimed in claim 3, wherein:

a) said bottom panel is connected integrally to said front and back panels.

5. A holder as claimed in claim 3, wherein:

a) said bottom panel connects to a central portion of said lower end of said back panel.

6. A holder as claimed in claim 5, wherein:

a) said bottom panel extends in a plane substantially aligned with said lower edges of said side panels and foot portions; and b) said bottom panel includes rear side edge portions disposed on each side of and offset rearwardly from said central portion.

7. A holder as claimed in claim 1, wherein:

a) each foot portion includes an accurately curved upper edge.

8. A holder as claimed in claim 1, wherein:

a) each side panel tapers in width upwardly from said lower edge of said side panel.

9. A holder as claimed in claim 1, wherein:

a) said connecting mean comprises a flap with a slot provided on an edge of one of said side panel and said front panel and tab engageable in said slot provided on an edge of the other of a side panel and said front panel.

10. A holder as claimed in claim 3, wherein:

a) said connecting means comprises a flap with a slot provided on one of each of said side panels and each end edge of said front panel; and b) a tab engageable in said slot provided on the other of each of said side panels and each end edge of said front panel.

11. A flat blank foldable to form a holder for literature, comprising:

a) a back panel having first and second opposite end portions and side edges;

b) a side panel connected to each side edge by a first weakening line;

c) each side panel having a foot portion adjacent to said first end portion of said back panel, each foot portion projecting laterally inwardly with respect to said first weakening line and separated from a central portion of said back panel by a cut extending laterally inwardly from said first weakening line generally in the direction from said second end portion of said back panel towards said first end portion of said back panel;

d) each side panel having an edge inclining laterally inwardly from an outer edge of said side panel generally in the direction from said first end portion towards said second end portion of said back panel; and e) a front panel connectable to bridge between said outer edge of each side panel when said side panels are folded about said first weakening lines to extend substantially parallel to one another in respective planes and substantially perpendicular to the plane of said back panel.

12. A blank as claimed in claim 11, wherein:

a) each said first weakening line extends from said second end portion and terminates at said cut so that folding each side panel inwardly forwardly with respect to said back panel swings said foot portions outwardly from the plane of said back panel to extend rearwardly therefrom.

13. A blank as claimed in claim 11, and further comprising:

a) a bottom panel having a width substantially the same as said back panel;

b) said bottom panel connected by a second weakening line to said first end portion of said back panel; and c) said bottom panel connected to said front panel by a third weakening line substantially parallel to said second weakening line between said back and bottom panels.

14. A blank as claimed in claim 13, wherein:

a) said cuts terminate adjacent opposite ends of said second weakening line between said back and bottom panels.

15. A blank as claimed in claim 14, wherein:

a) a generally lateral cut separates each said inclining edge of said side panel from said bottom panel; and b) said second weakening line between said back and bottom panels substantially aligns with the points of intersection between the sides of said bottom panel and said inclining edge of said side panel.

16. A blank as claimed in claim 11, wherein:

a) each said cut provides an arcuate edge of said foot portion.

17. A blank as claimed in claim 11, wherein:

a) each side panel tapers in width in the direction from said first to said second end portion.

18. A blank as claimed in claim 11, and further comprising:

a) a flap with a slot provided on an edge of one of said side panel and said front panel and a tab engageable with said slot provided on an edge of the other of said side panel and said front panel.

19. A blank as claimed in claim 13, and further comprising:

a) a flap with a slot provided on one of each said side panels and each end edge of said front panel; and b) a tab engageable in said slot provide on the other of each of said side panels and each end edge of said front panel.

* * * * *